US009371117B2

(12) United States Patent
Cheng

(10) Patent No.: US 9,371,117 B2
(45) Date of Patent: Jun. 21, 2016

(54) RESCUE SYSTEM FOR SEMI-SEALED MARINE VESSELS

(71) Applicant: Chih-Yuan Cheng, Taipei (TW)

(72) Inventor: Chih-Yuan Cheng, Taipei (TW)

( * ) Notice: Subject to any disclaimer, the term of this patent is extended or adjusted under 35 U.S.C. 154(b) by 108 days.

(21) Appl. No.: 14/253,882

(22) Filed: Apr. 16, 2014

(65) Prior Publication Data

US 2015/0298777 A1 Oct. 22, 2015

(51) Int. Cl.
*B63B 43/12* (2006.01)

(52) U.S. Cl.
CPC ..... *B63B 43/12* (2013.01); *B63B 2043/126* (2013.01)

(58) Field of Classification Search
CPC .. B63B 43/10; B63B 43/12; B63B 2043/123; B63B 2043/126
USPC ..... 114/68, 69, 227, 228, 229, 50, 52, 54, 114/125, 123
See application file for complete search history.

(56) References Cited

U.S. PATENT DOCUMENTS 1,113,257 A * 10/1914 Sprague ..... B63B 43/14 114/68
1,133,928 A * 3/1915 Cahill ..... B63B 43/14 114/68
1,149,709 A * 8/1915 Wortherspoon ..... B63B 43/14 114/68
1,156,792 A * 10/1915 McAvoy ..... B63B 43/14 114/68
1,328,122 A * 1/1920 Buell ..... B63B 43/12 114/68
3,092,853 A * 6/1963 Owen ..... B63B 43/14 114/68
3,440,989 A * 4/1969 Ettinger ..... B63B 43/14 114/68
4,458,618 A * 7/1984 Tuffier ..... B63B 43/12 114/360
6,526,900 B2 * 3/2003 Redman ..... B60F 3/0038 114/123
9,139,267 B2 * 9/2015 Zablocki ..... B63B 43/10
2007/0089655 A1 * 4/2007 Olson ..... B63B 22/12 114/51
2007/0199499 A1 * 8/2007 Hughes ..... B64D 25/18 114/360
2008/0257248 A1 * 10/2008 Randell ..... B63B 43/12 114/360

* cited by examiner

*Primary Examiner* — Andrew Polay
(74) *Attorney, Agent, or Firm* — Leong C. Lei

(57) ABSTRACT

Disclosed is a rescue system for semi-sealed marine vessels, which includes a rescue unit and a backup rescue machine. The rescue unit is installed in a vessel compartment and includes an air bag, a canister containing compressed gas, a needle valve, and a flow control valve for employing the physical property that air has a specific gravity smaller than water, whereby when water leaks into the vessel compartment, through pressing down the needle valve, the compressed air is supplied into the air bag for inflating and expanding the air bag to get floating on the seawater inside the vessel compartment and occupy the internal space of the vessel compartment. The backup rescue machine includes an air compressor and at least a diversion valve to supplement a great amount of high-pressure gas to the vessel compartment for preventing water leaking into the vessel compartment.

8 Claims, 10 Drawing Sheets

RESCUE SYSTEM FOR SEMI-SEALED MARINE VESSELS

TECHNICAL FIELD OF THE INVENTION

The present invention generally relates to a rescue system for marine vessels, and more particularly to a rescue system for semi-sealed marine vessels.

DESCRIPTION OF THE PRIOR ART

Traditional marine rescue operation is generally dependent on rescue devices and rescue teams. For rescue of vessels, water pumps are relied upon for removing seawater leaking into the vessel compartment. A disadvantage is that it cannot stop leaking and consequently, the water pump must be kept in operation to remove the invasion seawater. In case the capacity of the pump for removing water is less than water invasion rate, then the rescue will fail. The time that is available for rescue is thus short. In addition, there needs sufficient supply of electrical power and fuel and skilled operators.

SUMMARY OF THE INVENTION

An object of the present invention is to provide a rescue system for semi-sealed marine vessels that provides excellent effectiveness, has a simple structure, is easy to install, and unlimitedly extends the available rescue awaiting time and is capable of fast restoring the floating power of the vessel.

To achieve the above object, the present invention comprises, structurally, a rescue unit and a backup rescue machine. The rescue unit is arranged in a vessel compartment of a marine vessel. The rescue unit comprises at least an air bag, a canister, a needle valve, a flow control valve, and a safety clip. The canister contains therein high-pressure gas. The flow control valve is arranged at a sealed opening of the canister. The needle valve is coupled to and partially extends into the flow control valve. The flow control valve is in communication with the air bag. The safety clip is mounted between the needle valve and the flow control valve to constrain movement of the needle valve, wherein when the safety clip is removed, the needle valve is allowed to move for pierce through and break the sealed opening of the canister. The backup rescue machine assists the rescue unit and supplies high-pressure gas to the vessel compartment of the marine vessel. The backup rescue machine comprises an electric motor, an air compressor, a pressure buffering box, and at least a diversion valve. The electric motor, the air compressor, and the pressure buffering box are connected. The diversion valve is connected to the pressure buffering box and is also connected to a blower piping line and a backup rescue piping line so that the diversion valve switches communication of the blower piping line and the backup rescue piping line with the vessel compartment of the marine vessel.

The needle valve can be used to pierce through and break the sealed opening of the canister to allow the high-pressure gas to flow into the air bag, whereby the air bag is inflated and occupies the interior space of the vessel compartment. Seawater is subjected to a pressure induced by the gas and becomes hard to further leak into the vessel compartment or is even forced to flow in a reversed direction to get out of the vessel compartment.

The backup rescue machine can be used to assist the rescue unit by supplying high-pressure air provided by the air compressor into the vessel compartment to take the place of the rescue unit to prevent invasion of seawater and to restore the floating power of the marine vessel for awaiting external rescue so as to achieve the purposes of preventing sinking of the marine vessel and being capable of long awaiting external rescue.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
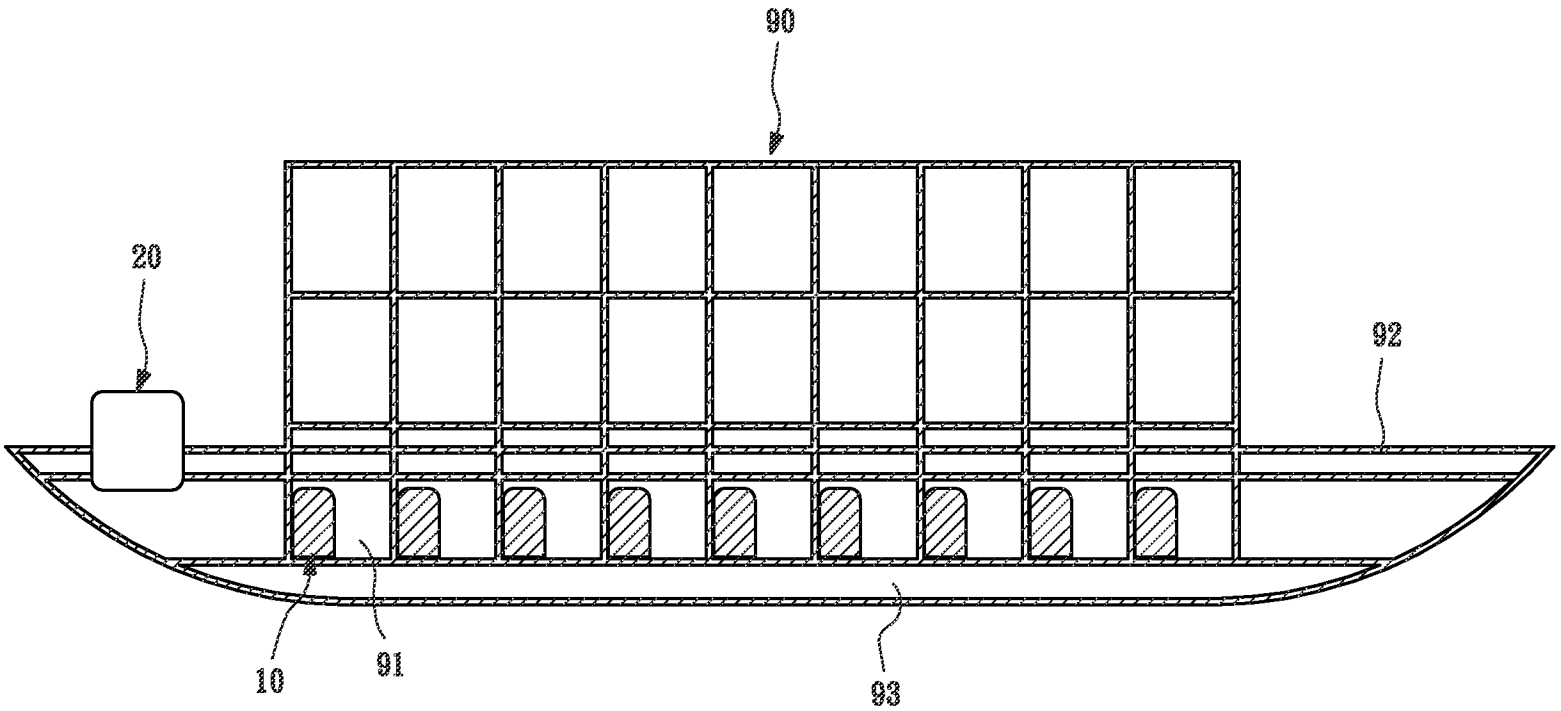
FIG. 1 is a schematic view illustrating the installation of the present invention.
Figure 2:
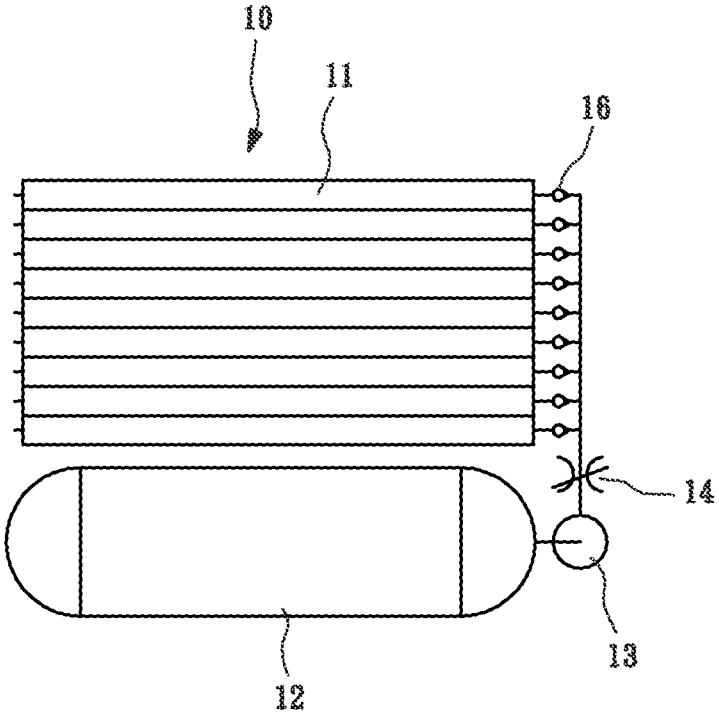
FIG. 2 is a view schematically illustrating the structure of a rescue unit according to the present invention.
Figure 3:
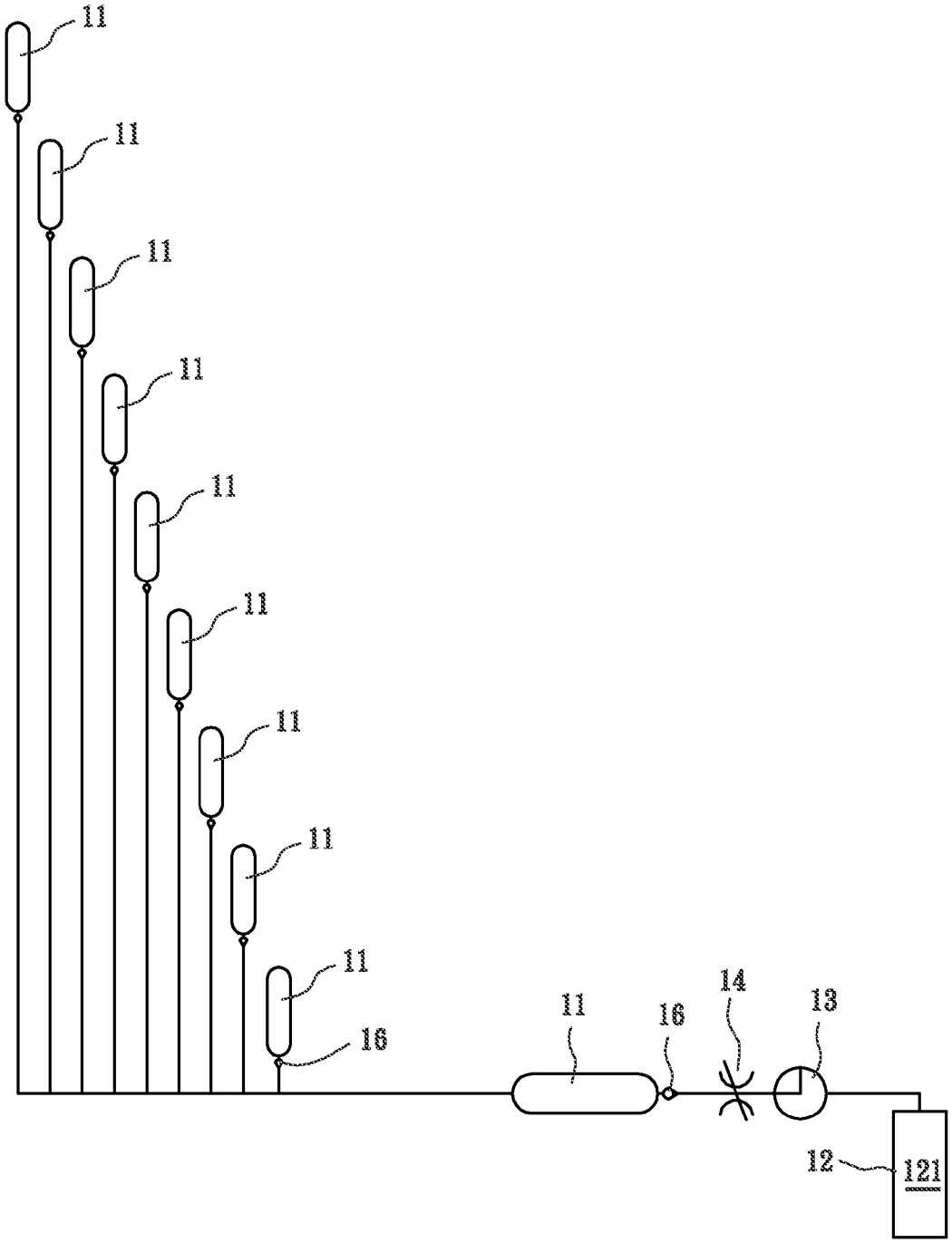
FIG. 3 is another view schematically illustrating the structure of a rescue unit according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-10, the present invention is applicable to a marine vessel 90 and comprises, structurally, a rescue unit 10 and a backup rescue machine 20.

The rescue unit 10 is installed in a lower vessel compartment 91 of the marine vessel 90 and is generally not allowed to install in a vessel compartment above a deck 92 of the marine vessel 90 and a ballast tank 93 of the marine vessel 90. The rescue unit 10 comprises a plurality of air bags 11, a canister 12, a needle valve 13, a flow control valve 14, and a safety clip 15. The canister 12 is filled in advance and stores therein high-pressure gas. The flow control valve 14 is mounted to a sealed opening of the canister 12. The needle valve 13 is coupled to and partially received in the flow control valve 14. The flow control valve 14 is in communication with the air bags 11. The safety clip 15 is mounted between the needle valve 13 and the flow control valve 14 to constrain movement of the needle valve 13, whereby when the safety clip 15 is removed, the needle valve 13 is allowed to move to pierce through the sealing of the opening of the canister 12. The safety clip 15 functions to prevent unexpected piercing of the opening seal of the canister 12 by the needle valve 13. To use in rescue, the safety clip 15 is first removed and then the needle valve 13 can be pressed down to allow air to be filled into the air bags 11.

When not inflated, the air bags 11 are kept in a flat form for easy folding and after being inflated, they turn into a form of a cluster of inflated balloons to be spread on the surface of water flowing into the interior space of the vessel compartment 91. The air bags 11 are connected in a parallel arrangement so that each is independent of the others. Breaking of any one of the air bags 11 does not affect the others.

The canister 12 can be of a shape similar to a carbon dioxide fire extinguisher and contains a high-pressure gas 121 therein, such as ordinary air or a no-toxicant gas, such as carbon dioxide and nitrogen. The sealed opening of the canister 12 is arranged to oppose a tip of the needle valve 13 and is made of a material that is piercingly breakable by the tip of the needle valve 13.

The tip of the needle valve 13 is sharp and opposes the sealed opening of the canister 12. The tip of the needle valve 13 is movable toward the sealed opening of the canister 12 to pierce through and break the opening sealing of the canister 12 in order to allow the high-pressure gas 121 contained in the canister 12 to automatically discharge. The needle valve 13 comprises a stop 131 fit thereon in such a way that the stop 131 is located in the flow control valve 14 for preventing the needle valve 13 from separation when the needle valve 13 is moved in a direction away from the flow control valve 14.

The flow control valve 14 comprises a gas tube 141 and a gas chamber 142. The gas tube 141 is mounted to an external surface of the flow control valve 14 and the gas tube 141 is connected to the air bags 11. The gas chamber 142 is arranged to fit to the sealed opening of the canister 12 and is in communication with the gas tube 141. The high-pressure gas 121 contained in the canister 12 can flow through the gas chamber 142 and the gas tube 141 to fill into the air bags 11. The flow control valve 14 functions to control the flow rate of the high-pressure gas 121 discharging from the canister 12 in order to prevent excessively fast inflation of the air bags 11 that might cause people to be trapped in the vessel compartment 91.

A check valve 16 is arranged between the flow control valve 14 and the air bags 11. The check valve 16 functions to prevent reverse flow when the high-pressure gas 121 of the canister 12 is released into the air bags 11.

An elastic body 17 is arranged between the needle valve 13 and the flow control valve 14. The elastic body 17 can be a spring. The elastic body 17 has two ends respectively supported on the needle valve 13 and the flow control valve 14. When the safety clip 15 is removed and the needle valve 13 moves to pierce through and break the sealed opening of the canister 12, the elastic body 17 provides an elastic force to have the tip of the needle valve 13 withdrawn out of the opening of the canister 12 and returned to the original position, whereby the opening of the canister 12 is set in a wide open condition to allow the high-pressure gas 121 of the canister 12 to smoothly flow into the air bags 11.

The backup rescue machine 20 functions for assisting the rescue unit 10 and supplies a high-pressure gas 121 into the vessel compartment 91 of the marine vessel 90. The backup rescue machine 20 comprises an electric motor 21, an air compressor 22, a pressure buffering box 23, and a plurality of diversion valves 24. The electric motor 21, the air compressor 22, and the pressure buffering box 23 are connected. The diversion valves 24 are connected to the pressure buffering box 23 and are connected to a blower piping line 30 and a backup rescue piping line 40. The diversion valves 24 function to switch the connection of the blower piping line 30 and the backup rescue piping line 40 with the vessel compartment 91 of the marine vessel 90.

Figure 4:
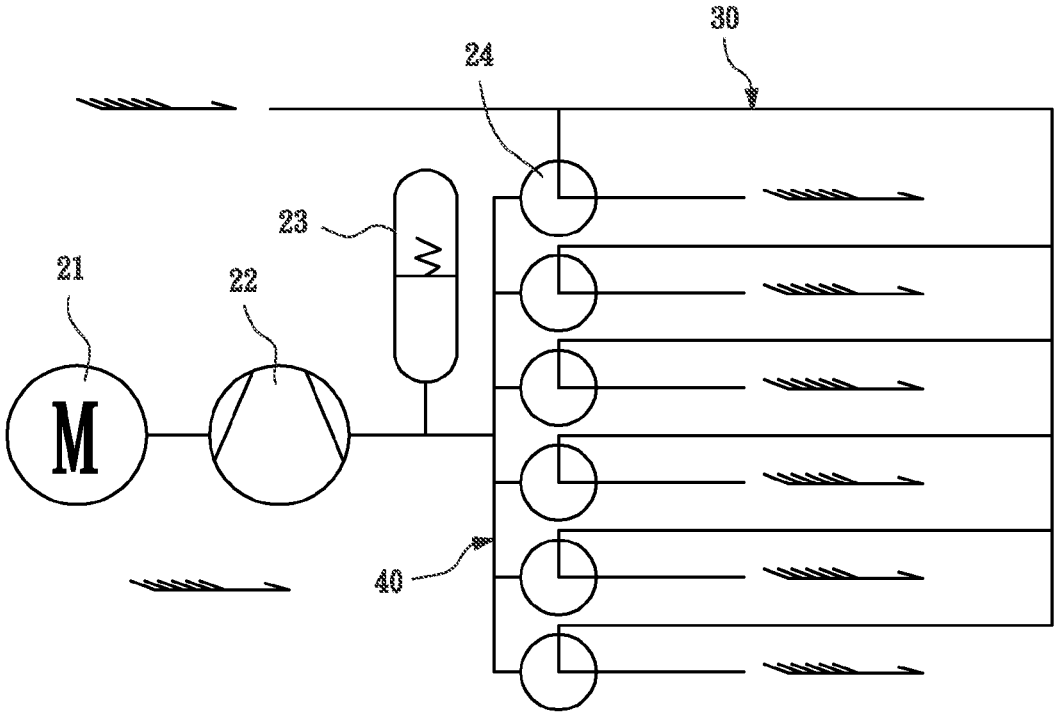
FIG. 4 is a schematic view illustrating a high-pressure gas piping line network according to the present invention.

Referring to FIGS. 1 and 4, the backup rescue machine 20 is installed on the deck 92. In a shut-down condition, the diversion valves 24 close the backup rescue piping line 40 and cut off the communication thereof with the blower piping line 30, so that only the blower piping line 30 is operative.

Figure 5:
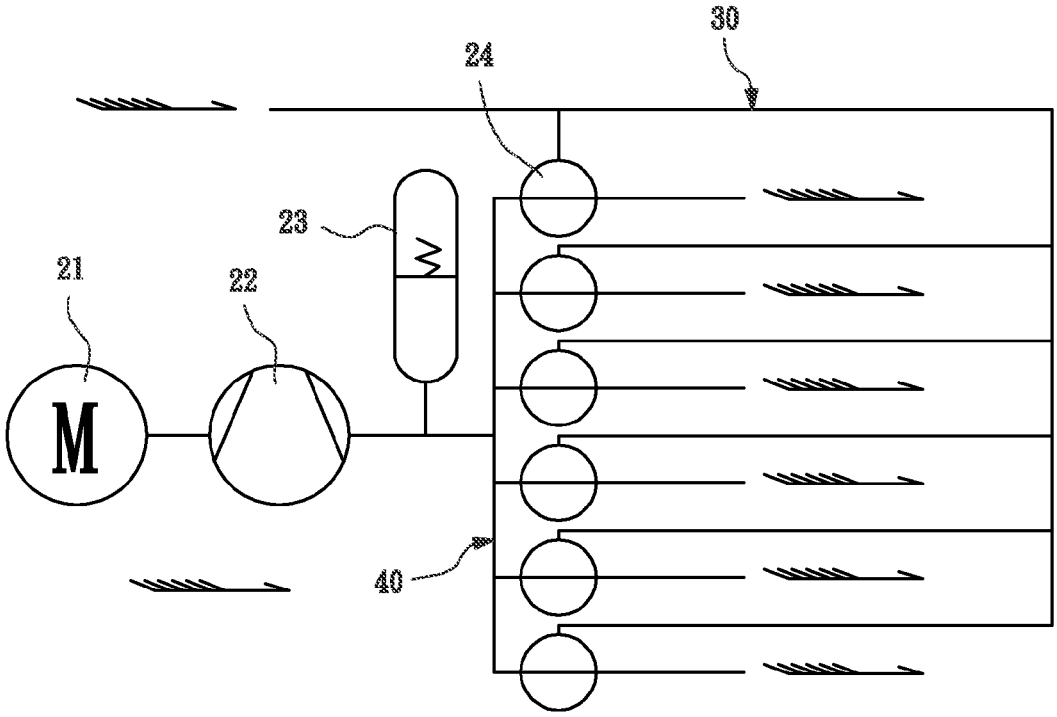
FIG. 5 is another schematic view illustrating a high-pressure gas piping line network according to the present invention.

Referring to FIGS. 1 and 5, the air compressor 22 of the backup rescue machine 20 may generate high-pressure gas and in a rescue operation, the diversion valves 24 close the blower piping line 30 and at the same time, open the backup rescue piping line 40 to establish communication thereof with the blower piping line 30, whereby the high-pressure gas generated by the air compressor 22 is allowed to flow through the pressure buffering box 23, the backup rescue piping line 40, and the diversion valves 24 so as to pump the high-pressure gas into the vessel compartment 91 to supplement and maintain the pressure inside the vessel compartment 91.

The high-pressure gas flow supplied from the air compressor 22 flows through the diversion valves 24, the backup rescue piping line 40 (being opened), the blower piping line 30 (being closed), for being pumped into the vessel compartment 91. The backup rescue piping line 40 and the blower piping line 30 are connected to each other and are switched through the diversion valves 24, this being the shared piping line.

The pressure buffering box 23 functions to absorb pressure shock waves, protecting the electric motor 21 from overloading and preventing burning down by high starting current.

Figure 6:
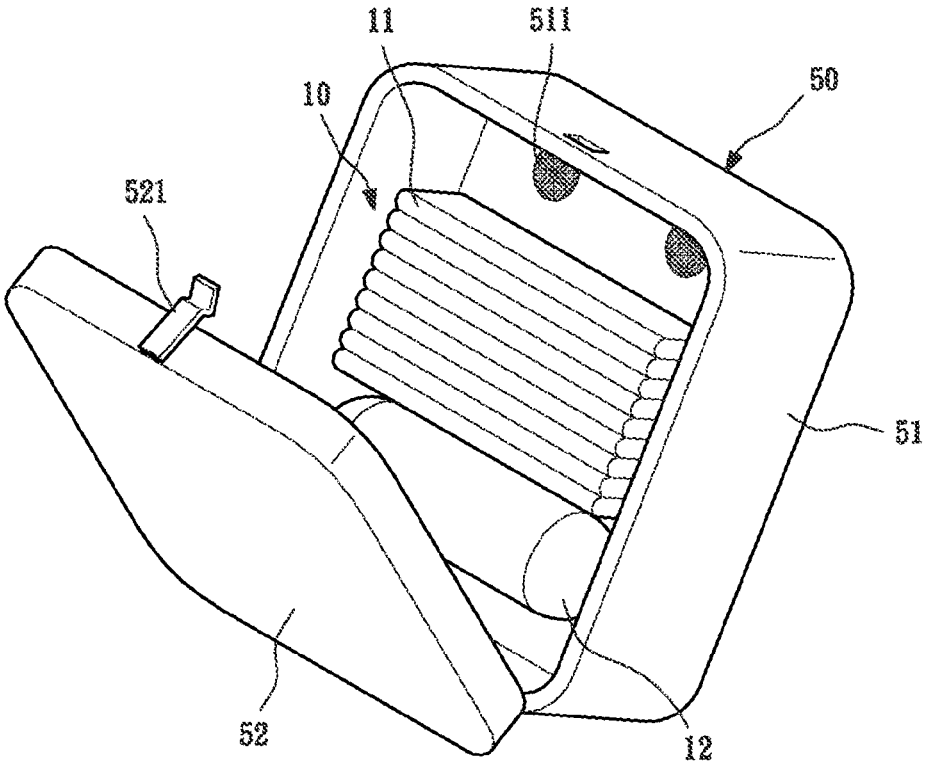
FIG. 6 is a perspective view showing a rescue unit according to the present invention with an external casing open.
Figure 7:
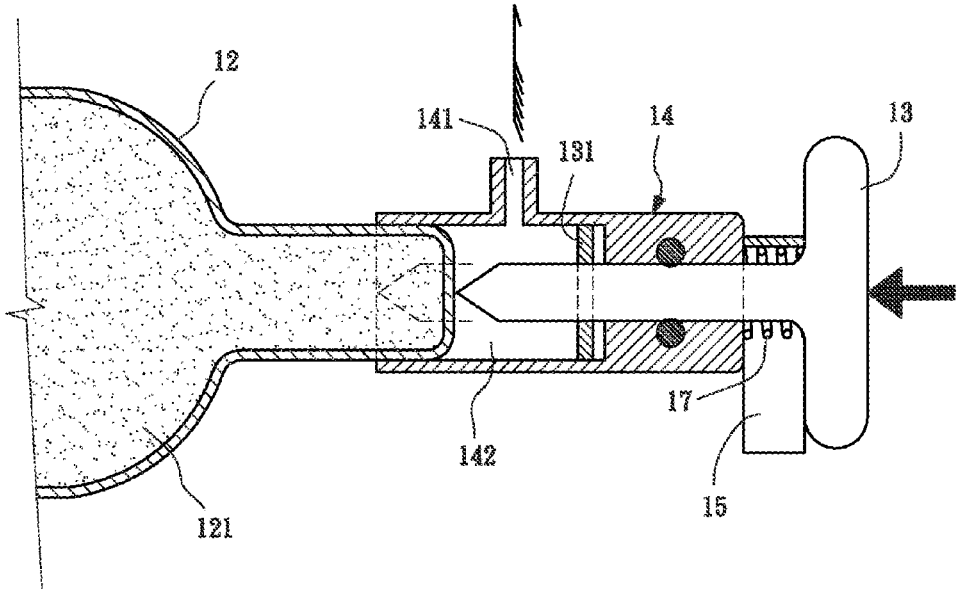
FIG. 7 is a cross-sectional view of the rescue unit according to the present invention.
Figure 8:
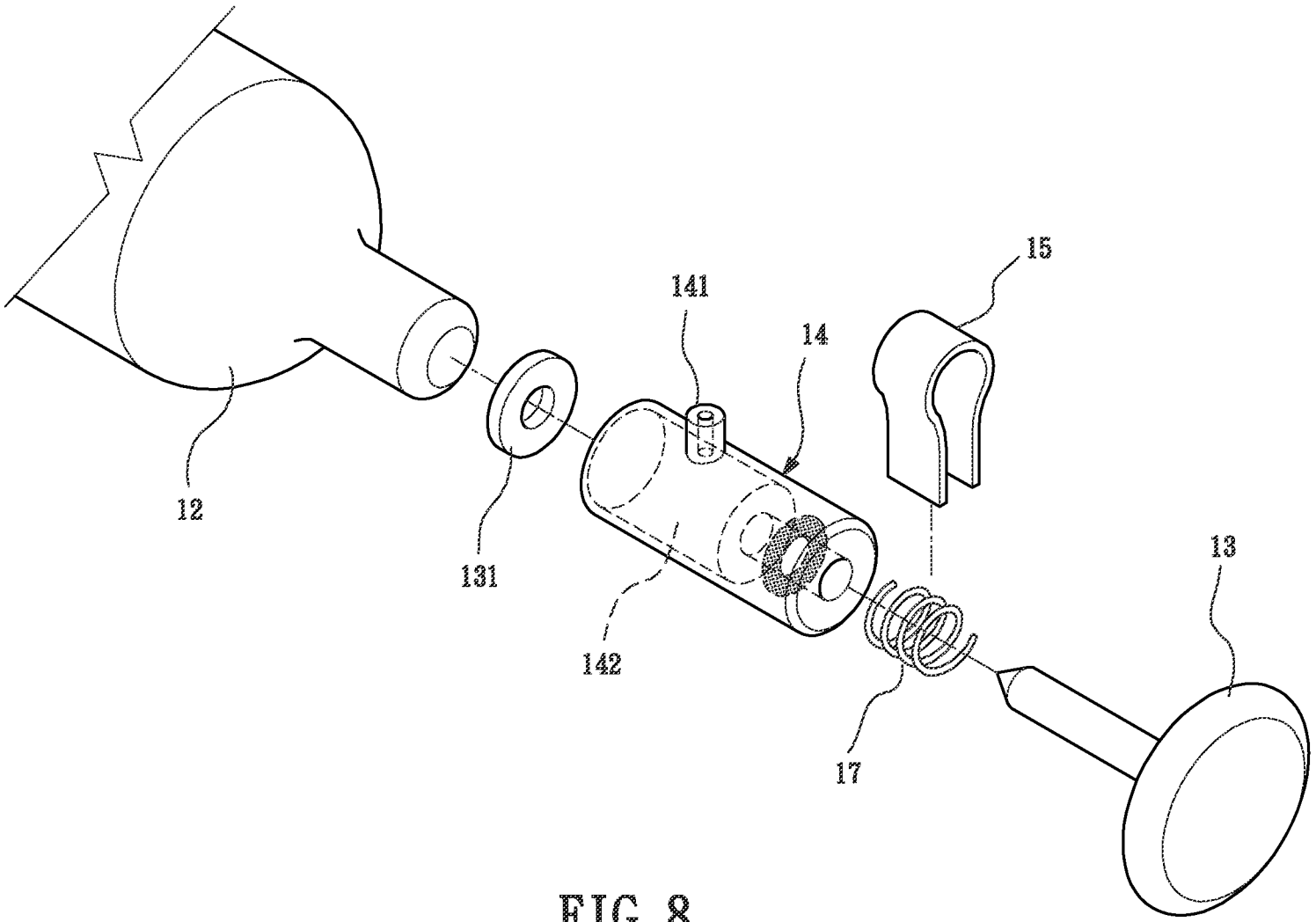
FIG. 8 is an exploded view of the rescue unit according to the present invention.
Figure 9:
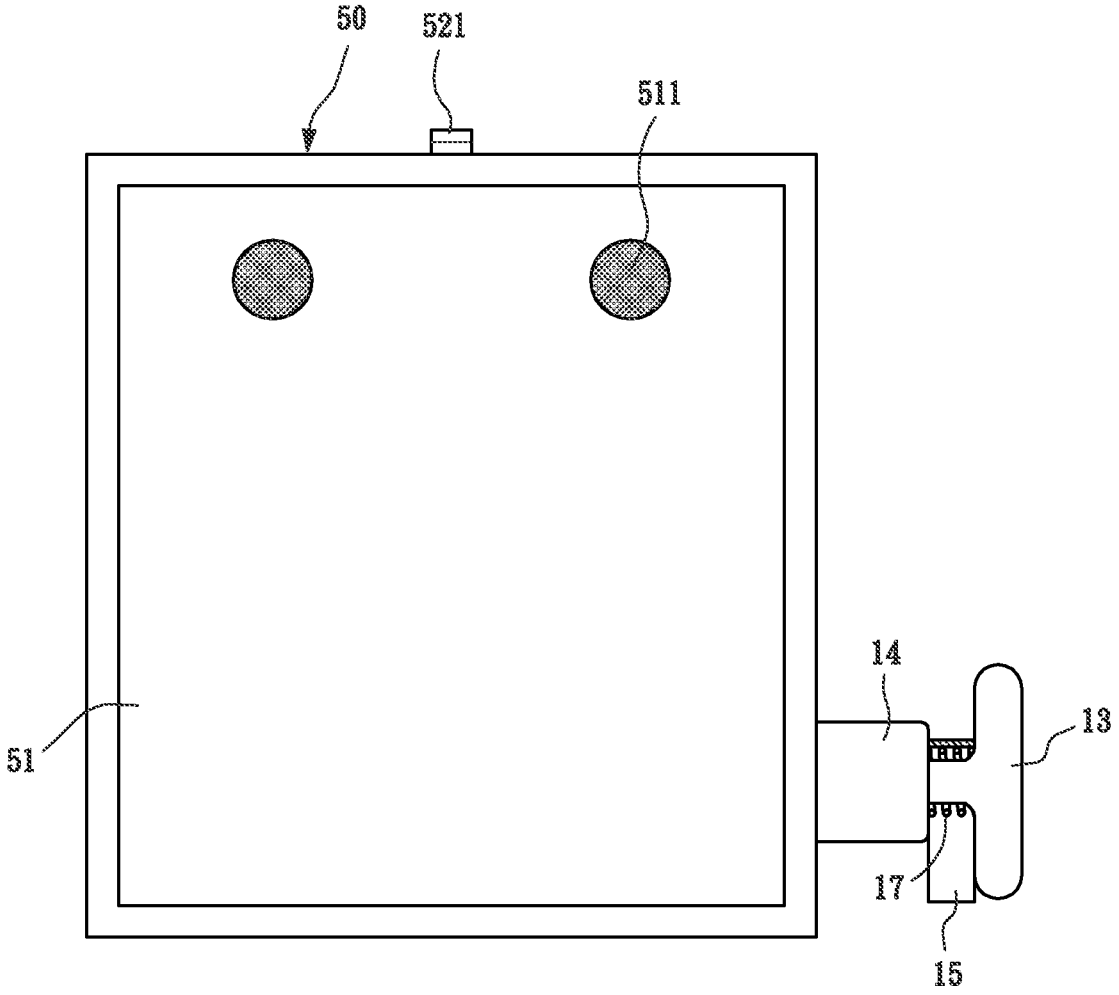
FIG. 9 is a view showing a rear side of the external casing of the rescue unit according to the present invention.
Figure 10:
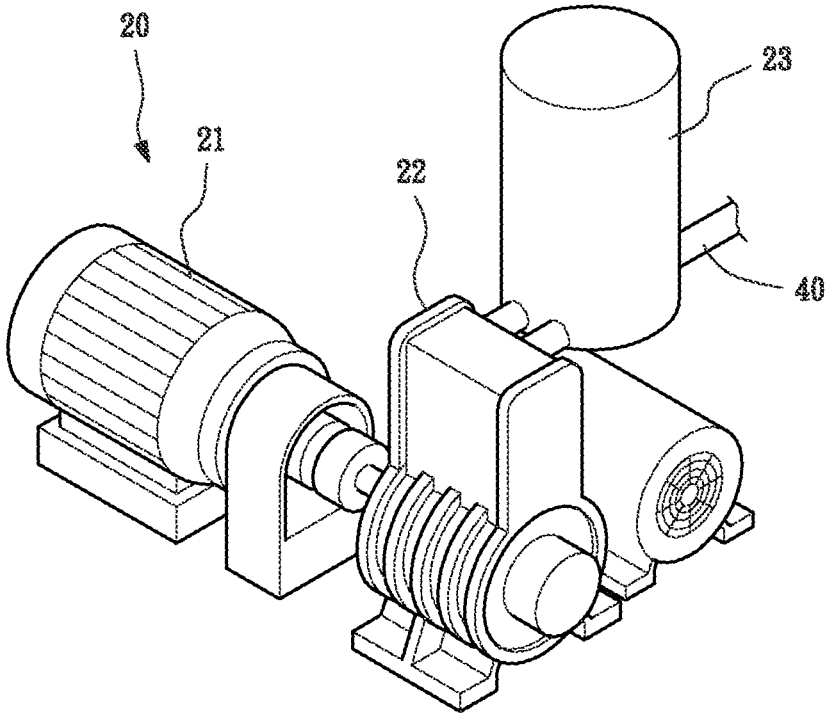
FIG. 10 is a perspective view illustrating an intermediate rescue machine according to the present invention.
Figure 11:
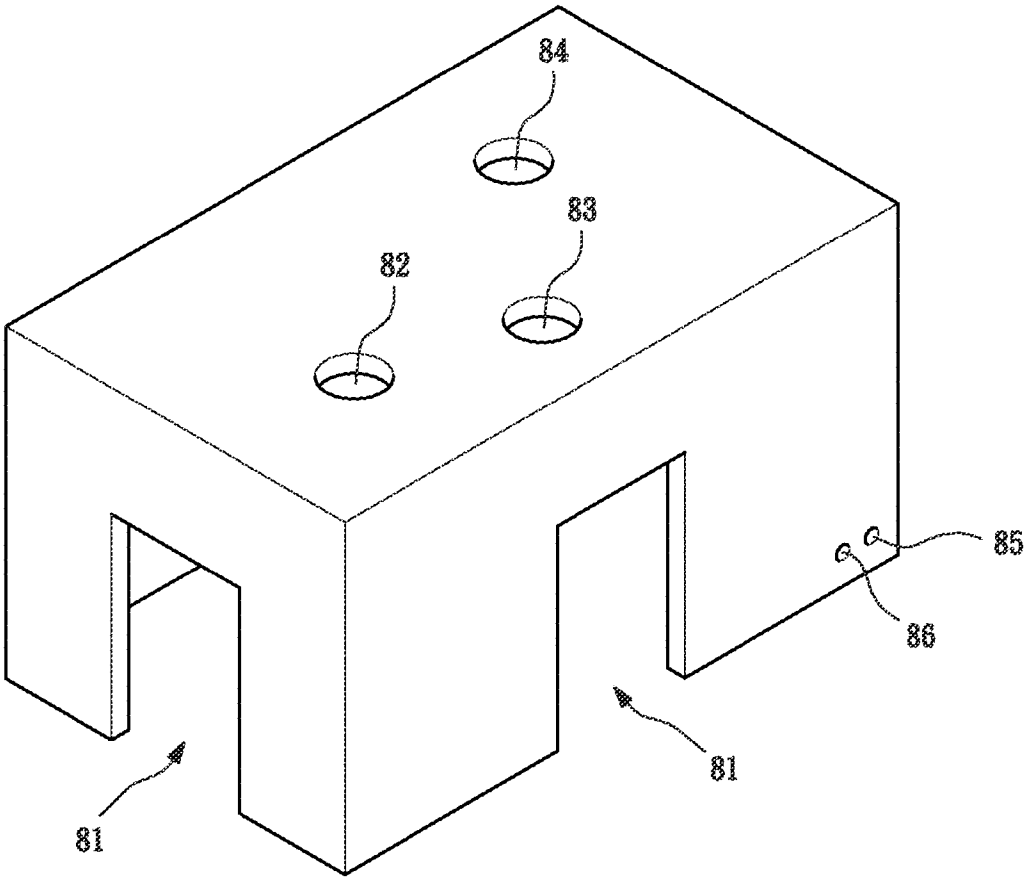
FIG. 11 is a schematic view illustrating a semi-sealed vessel compartment according to the present invention.

Referring to FIGS. 6 and 9, the rescue unit 10 can be arranged in a suspension device 50 to facilitate the installation of the rescue unit 10. The suspension device 50 comprises an openable external casing 51 and external cover 52, which collectively show a cabinet like configuration when not opened to receive and hold the rescue unit 10 therein. The external casing 51 has a rear side on which a plurality of magnets 511, such as permanent magnets, are mounted so as to make use of the attraction forces of the magnets 511 to attach to a steel wall of the vessel, or alternatively, attachment can be realized through screwing or welding.

The external cover 52 comprises a snap fastener 521. The external cover 52 uses a spring force of the snap fastener 521 to set up snap engagement with the external casing 51 for closing with the needle valve 13 exposed outside the external casing 51. As such, when the external cover 52 is not opened, the needle valve 13 can be accessed and pressed down to pierce through and break the sealed opening of the canister 12 in order to inflate the air bags 11. With the inflation and expansion of the air bags 11, the expansion force is sufficient to overcome the spring force of the snap fastener 521 to thereby open the external cover 52. Thus, no manual intervention for opening is necessary.

Referring to FIGS. 1-3, 5, 7, and 11, for rescue of a vessel, ventilation openings that allows for great flow rates, such as a vessel compartment door 81, are closed, ventilation holes 82, air-conditioner airflow outlets 83, and waste gas outlets 84 can be combined with the shared piping line of the backup rescue piping line 40 and the blower piping line 30. As to minute leaking sites, such as leaking gaps of such as wall water pipe passages 85 and wall electrical cable passages can be compensated by the air compressor 22.

Immediately after a peril occurs, the rescue unit 10 is activated. After the air bags 11 have been completely inflated, if the effectiveness is not sufficient, then the backup rescue machine 20 is activated. If the effectiveness is still insufficient, then inspection of air leaking of the vessel compartment should be done and repaired or remedied.

The top priority for rescue is to operate the rescue unit 10, where a responsible crew member pulls off the safety clip 15 and then presses down the needle valve 13 to break the opening seal of the canister 12 to release the pre-stored the high-pressure gas 121 for inflating the air bags 11 and the crew member, before the air bags 11 have been completely inflated, must leave the compartment door 81 and positively close the compartment to prevent overflow of seawater. In a second instance, the crew member activates the backup rescue machine 20 to pump high-pressure gas into the vessel compartment 91 to supplement and maintain the inside pressure of the vessel compartment 91.

The present invention provides the following advantages:

(1) Easy use: The operation of the rescue unit requires only one action of pressing down the needle valve.

(2) Fast inflation: The compressed gas contained in the canister is under a high pressure and can be of a great flow speed and a large flow rate to instantaneously fill up the air bags, providing sufficient time for the backup rescue machine to warm up and start up.

(3) Small occupation space: The air bags are in the form of a flat piece when not in use so that the occupation space required for storage is small.

(4) Extended rescue awaiting time: The backup rescue machine uses the air compressor to supply compressed air in a non-interrupted manner so that the marine vessel can long maintain floating power, not getting sinking, and the time that is available for awaiting rescue can be extended.

When the rescue unit and the backup rescue machine are operated to effect, invasion of seawater can be stopped (the amount of water leaking into the vessel being less than the supply of compressed air), and the rescue operation is completed to overcome the peril.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A rescue system for semi-sealed marine vessels, comprising:

a rescue unit, which is arranged in a vessel compartment of a marine vessel, the rescue unit comprising at least an air bag, a canister, a needle valve, a flow control valve, and a safety clip, the canister containing therein high-pressure gas, the flow control valve being arranged at a sealed opening of the canister, the needle valve being coupled to and partially extending into the flow control valve, the flow control valve being in communication with the air bag, the safety clip being mounted between the needle valve and the flow control valve to constrain movement of the needle valve, wherein when the safety clip is removed, the needle valve is allowed to move for pierce through and break the sealed opening of the canister; and a backup rescue machine, which assists the rescue unit and supplies high-pressure gas to the vessel compartment of the marine vessel, the backup rescue machine comprising an electric motor, an air compressor, a pressure buffering box, and at least a diversion valve, the electric motor, the air compressor, and the pressure buffering box being connected, the diversion valve being connected to the pressure buffering box and also connected to a blower piping line and a backup rescue piping line so that the diversion valve switches communication of the blower piping line and the backup rescue piping line with the vessel compartment of the marine vessel.

2. The rescue system for semi-sealed marine vessels according to claim 1, wherein the opening seal of the canister is made of a material that is piercingly breakable by a tip of the needle valve.

3. The rescue system for semi-sealed marine vessels according to claim 1, wherein the needle valve comprises a stop and the stop is located in the flow control valve for preventing separation of the needle valve during the movement of the needle valve.

4. The rescue system for semi-sealed marine vessels according to claim 1, wherein the flow control valve comprises a gas tube and a gas chamber, the gas tube being mounted to an external surface of the flow control valve, the gas tube being connected to the air bag, the gas chamber being arranged to fit to the sealed opening of the canister and communicating with the gas tube.

5. The rescue system for semi-sealed marine vessels according to claim 1, wherein a check valve is arranged between the flow control valve and the air bag.

6. The rescue system for semi-sealed marine vessels according to claim 1, wherein the rescue unit is received in a suspension device, the suspension device comprising an external casing and an external cover that are openable.

7. The rescue system for semi-sealed marine vessels according to claim 6, wherein the external casing has a rear side to which a plurality of magnets is mounted.

8. The rescue system for semi-sealed marine vessels according to claim 6, wherein the external cover comprises a snap fastener, the external cover using a spring force of the snap fastener to set up snap engagement with the external casing for closing.

* * * * *